US006315533B1

(12) United States Patent
Lishanski et al.

(10) Patent No.: US 6,315,533 B1
(45) Date of Patent: Nov. 13, 2001

(54) VIBRATORY PUMP APPARATUS

(76) Inventors: Grigori Lishanski; Oleg Lishanski, both of 10112 W. Sharon La., Milwaukee, WI (US) 53225

( * ) Notice: Subject to any disclaimer, the term of this patent is extended or adjusted under 35 U.S.C. 154(b) by 0 days.

(21) Appl. No.: 09/526,240

(22) Filed: Mar. 15, 2000

Related U.S. Application Data

(60) Provisional application No. 60/126,040, filed on Mar. 19, 1999.

(51) Int. Cl.[7] ..... F04B 39/10
(52) U.S. Cl. ..... 417/545
(58) Field of Search ..... 417/545, 415, 417/416

(56) References Cited

U.S. PATENT DOCUMENTS

| | | | | |
|---|---|---|---|---|
| 76,318 | * | 3/1868 | Fisher | 417/545 |
| 2,634,684 | * | 4/1953 | Alvarez et al. | 417/413.1 |
| 2,732,806 | * | 1/1956 | Alvarez et al. | 417/413.1 |
| 4,147,476 | * | 4/1979 | Warren | 417/328 |
| 4,815,948 | * | 3/1989 | Aurelio | 417/413.1 |
| 5,165,871 | * | 11/1992 | Iwabuchi | 417/417 |

FOREIGN PATENT DOCUMENTS

| | | |
|---|---|---|
| 706573 | 9/1974 | (RU) . |
| 877146 | 7/1981 | (RU) . |
| 879051 | 7/1981 | (RU) . |
| 918575 | 12/1981 | (RU) . |
| 989166 | 9/1982 | (RU) . |
| 1090930 | 1/1984 | (RU) . |
| 1222905 | 12/1985 | (RU) . |
| 1642095 | 12/1990 | (RU) . |
| 1664387 | 7/1991 | (RU) . |

* cited by examiner

*Primary Examiner*—Teresa Walberg
*Assistant Examiner*—Vinod D. Patel
(74) *Attorney, Agent, or Firm*—Boyle, Fredrickson, Newholm, Stein & Gratz, S.C.

(57) ABSTRACT

A vibratory pump for transferring fluid is provided. The pump includes an oscillating hollow shaft connected to a motor. The shaft includes a plunger opposite the motor that has a number of openings through which the fluid may pass. The plunger engages a seating member disposed beneath the plunger to cut off fluid entering the plunger when the plunger is submerged. When the plunger disengages from the sealing member, a small vacuum is created which urges fluid into and through the plunger and shaft and onto a hose operably connected to an outlet end of the shaft.

20 Claims, 6 Drawing Sheets

VIBRATORY PUMP APPARATUS

CROSS-REFERENCE TO RELATED APPLICATIONS

This application is based on and claims priority from provisional patent application Ser. No. 60/126,040 filed on Mar. 19, 1999.

FIELD OF THE INVENTION

The present invention relates to the mechanical transfer of fluids and more specifically to a vibratory pump used to transfer fluid.

BACKGROUND OF THE INVENTION

When transferring fluid from a container holding the fluid, a pump of some type is normally used. The pump creates a vacuum that draws the fluid from the container and directs it to a desired location. A problem that occurs when using these conventional pumps is that, when the pump is turned off, there is a residual pressure remaining in the pump that forces a small amount of additional liquid out of the pump. If an individual is attempting to fill a container with the liquid, this additional liquid usually spills over the top of the container and is wasted. Therefore, it is desirable to develop a pump that eliminates any residual pressure in the pump when the pump is turned off to avoid losing any of the liquid being pumped.

SUMMARY OF THE INVENTION

It is an object of the invention to provide a vibratory pump that eliminates any residual pressure within the pump when the pump is switched off to avoid excess fluid loss.

It is a further object of the invention to provide a vibratory pump with the aforementioned feature that is inexpensive and simple in constructions.

The present invention is a vibratory pump apparatus that allows an individual to pump liquids to a desired location without encountering any problems caused by residual pressure normally remaining in prior art liquid pumping devices after the device has been switched off. Also, due to the use of inert materials in forming the apparatus, the apparatus may be used to pump caustic liquids, such as acids, without damaging the apparatus.

DETAILED DESCRIPTION OF THE INVENTION

Figure 1:
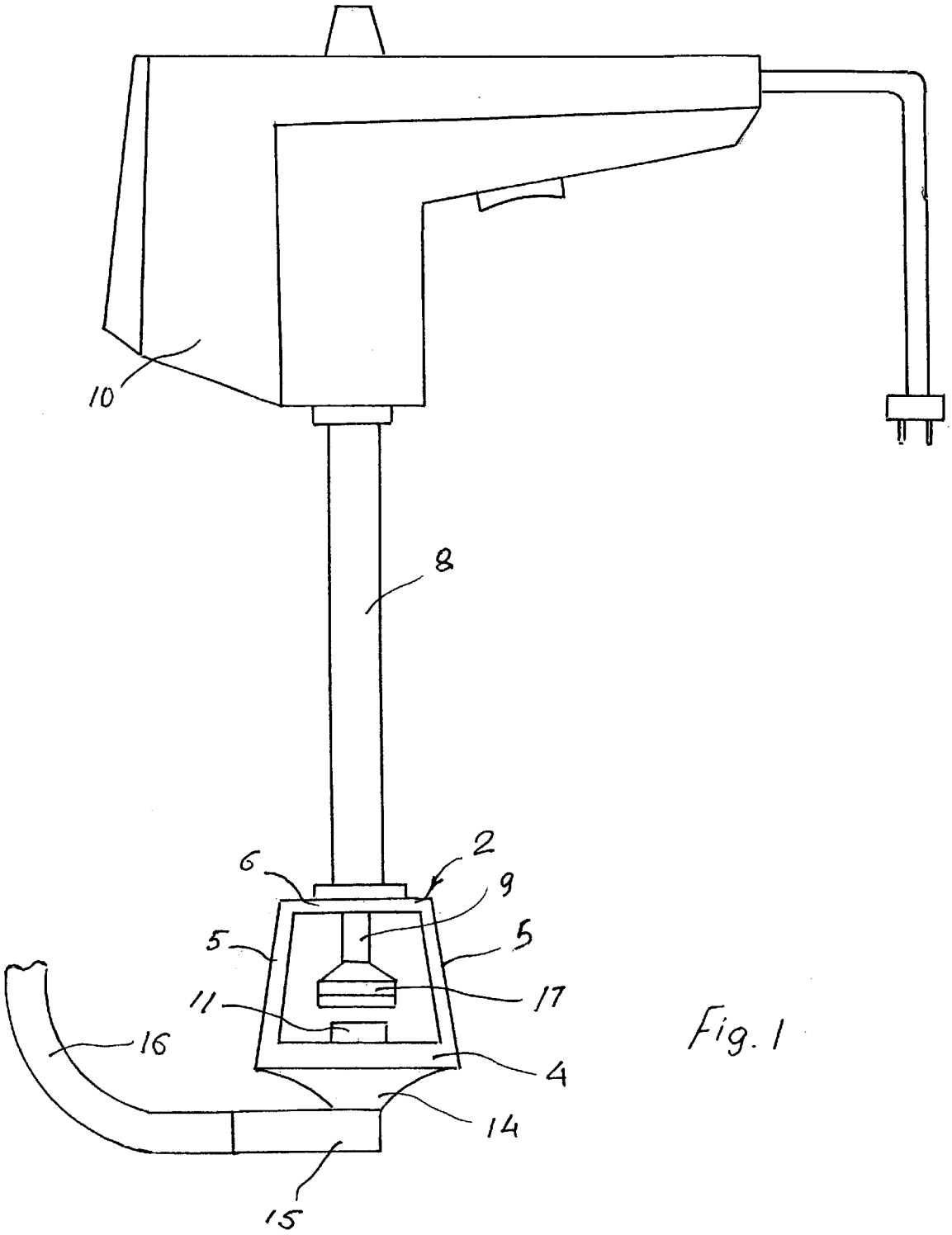
FIG. 1 is a front plan view of a vibratory pump apparatus constructed according to the present invention.
Figure 2:
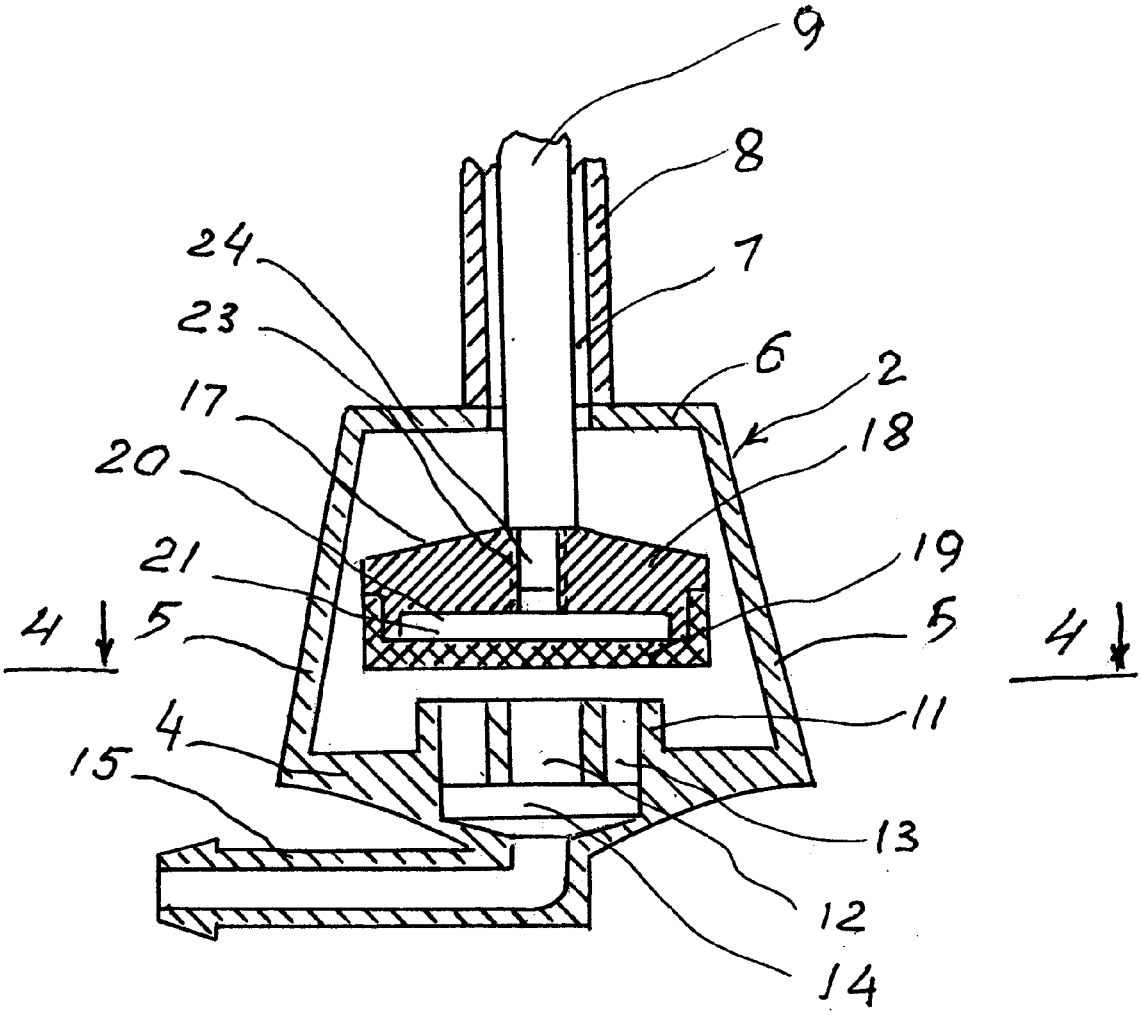
FIG. 2 is a cross-sectional view of an inlet branch pipe utilized in the vibratory pump apparatus of FIG. 1

The present invention is a vibratory pump apparatus including a new and novel inlet branch pipe 1 attached to a vibration generator 10, as shown in FIGS. 1 and 2. The inlet branch pipe 1 includes a pump case 2 that forms the body of the pipe 1. The pump case 2 is formed of an inert material, such as plastic, is generally cylindrical in shape, and is comprised of a circular base 4, a pair of wall members 5 upwardly extending perpendicular to the base 4, and a cover 6 connected to the wall members 5 opposite the base 4. The pump case 2 has a generally open interior, with the wall members 5 covering only a small portion of the circumference on either side of the pump case 2.

The cover 6 of the pump case 2 includes a central opening 7 around which is connected an inlet sleeve 8. The sleeve 8 extends away from the pump case 2 and is adapted to receive and engage a shaft 9 extending from a vibration generator 10. The generator 10 can be any suitable machine capable of producing regular, steady vibrations in a shaft 9 extending from the generator 10. Common types of these generators include electromagnetic vibration generators that are electrically or battery operated.

The base 4 of the pump case 2 includes a small annular shoulder 11 disposed about the center of base 4. The shoulder 11 includes a circular opening 12 disposed at its center extending completely through the shoulder 11 and base 4, as shown in FIG. 2. Opposite the base 4, the shoulder 11 supports one side of a flexible member 13. The member 13 is circular in shape and includes a downwardly extending peripheral ridge 14 which contacts the base 4 around the shoulder 11. The member 13 also includes a central opening 15 that aligns with the opening 12 in the 22 shoulder 11.

Disposed directly above the flexible member 13 is a stationary plunger 16 which is generally cylindrical in shape. The plunger 16 includes a base 17 positioned against flexible member 13, an upwardly extending cylindrical wall 18 that includes a number of oval passages 24 extending through the wall, and a cap 19 that includes an outwardly extending radial flange 20. The plunger 16 has an opening 21 disposed in the center of the circular base 17 that aligns with openings 15 and 12 in the flexible member 13 and raised shoulder 11, respectively, when positioned within the pump case 2. The plunger 16 may be secured in this position by threadably engaging a fastener 22 within the respective openings from the lower end of the pump case 2. In this manner, the plunger 16 is rigidly held within the pump case and serves as a conduit for fluid flow during operation of the pump.

Opposite the base 17, the plunger 16 includes a concave groove 23a in the outer edge of the radial flange 20. A resilient O-ring 23 is disposed within the groove and serves to provide a reliable fluid seal between the O-ring and the interior surface of a mobile chamber 25 positioned about the plunger 16.

The mobile chamber 25 is cylindrical in shape and is comprised of a circular side wall 26 having an inner diameter slightly less than the diameter of the O-ring 23. The chamber 25 includes a bottom, open end 28 and a top, closed end 29. The open end 28 of the chamber 25 allows the top 19 of plunger 16 to be inserted into the chamber such that the O-ring 23 sealingly engages the interior of the chamber. The open end 28 also includes an outwardly extending radial flange 30 that contacts the flexible member 13 during operation of the apparatus.

The closed end 29 includes a raised shoulder 31 extending upwardly from the closed end. The shoulder 31 includes an opening 32 that threadedly engages the lowermost portion 33 of the shaft 9 to secure the chamber 25 onto the shaft 9 such that vibration of the shaft affects the vibration of the chamber.

Adjacent the closed end 29 of the chamber 25 is also located an outlet 34 extending perpendicularly to the axis of the chamber 25. The outlet 34 is generally cylindrical in shape and includes a channel 35 that is in fluid communication with the interior of the chamber 25. When the plunger 16 is positioned within the chamber 25, the closed end 29 forms a fluid pumping enclosure 37 between the top 19 of the plunger 16 that is in fluid communication with the outlet 34. The outlet 34 extends beyond the pump case 2 and includes an outwardly extending angled flange 36 used to securely connect a hose 38 to the outlet 34 to direct the fluid flowing through the outlet to a desired location.

In operation, the plunger 16 is inserted with the chamber 25 and both parts are removably positioned inside the pump case 2. The plunger is then secured to the base 4 by fastener 22 and the shaft 9 is inserted into the sleeve 8 of the pump case 2. The lowermost portion 33 of the shaft 9 is then threadedly engaged with the opening 32 in the chamber 25 such that the chamber is positioned about 1–2.5 mm above the flexible member 13, a distance corresponding to the stroke length of the shaft 9. Next, hose 38 is connected to the outlet 34 about the angled flange 36 in order to direct the outgoing fluid flow. Then pump case 2 is inserted into the liquid that is to be pumped and the vibration vibrator 10 is activated.

Figure 4:
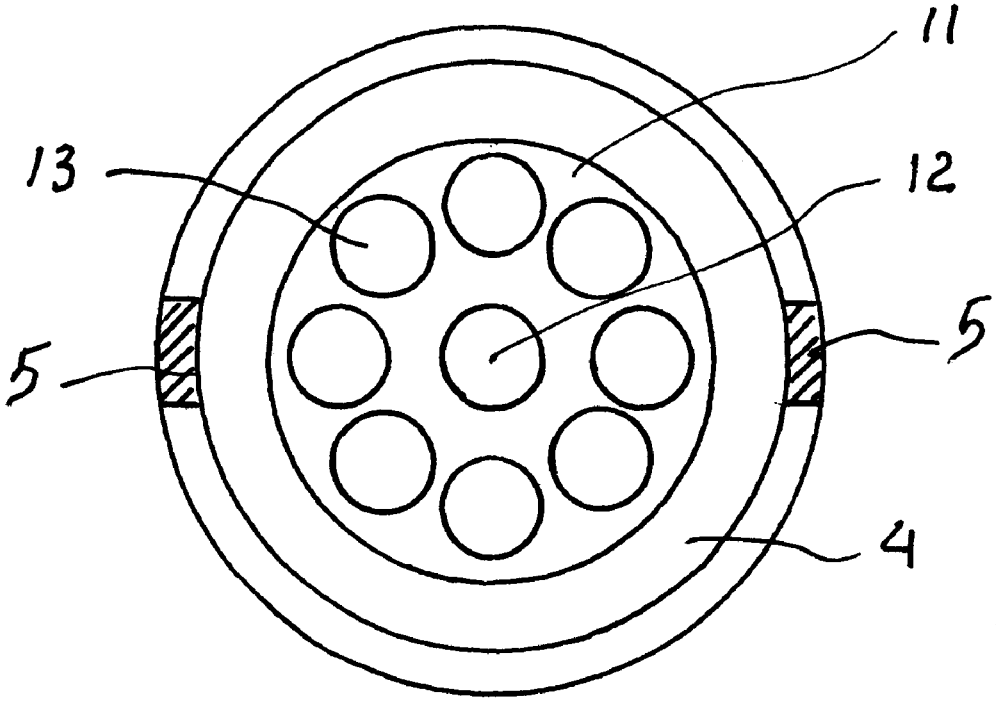
FIG. 4 is a cross-sectional view of an alternate embodiment of the inlet branch pipe of FIG. 2.

The configuration of the primary circular opening 12 and secondary openings 13 spaced about the central opening 12 is shown in FIG. 4. Both the central opening 12 and the secondary openings 13 have a circular cross-section enabling the liquid to be pumped to flow in a path directly downward from the top of the base 4.

Figure 5:
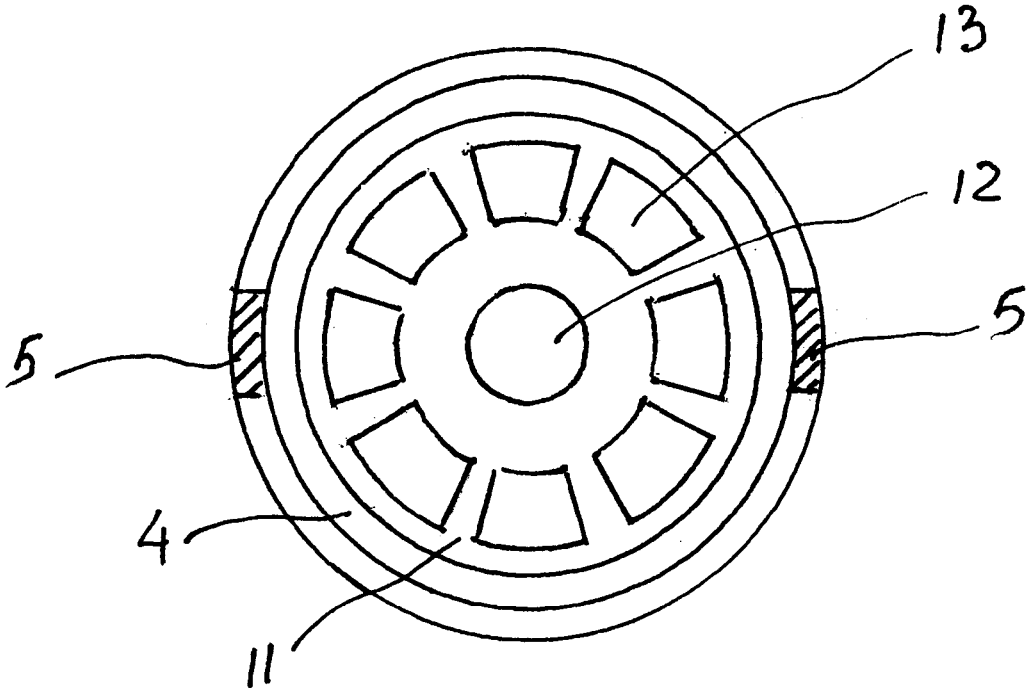
FIG. 5. is a cross-sectional view of a first alternate embodiment of the outlet opening configuration of FIG. 4; and FIG, 6. is a cross-sectional view of a second alternate embodiment of the outlet opening configuration of FIG. 4.
Figure 6:
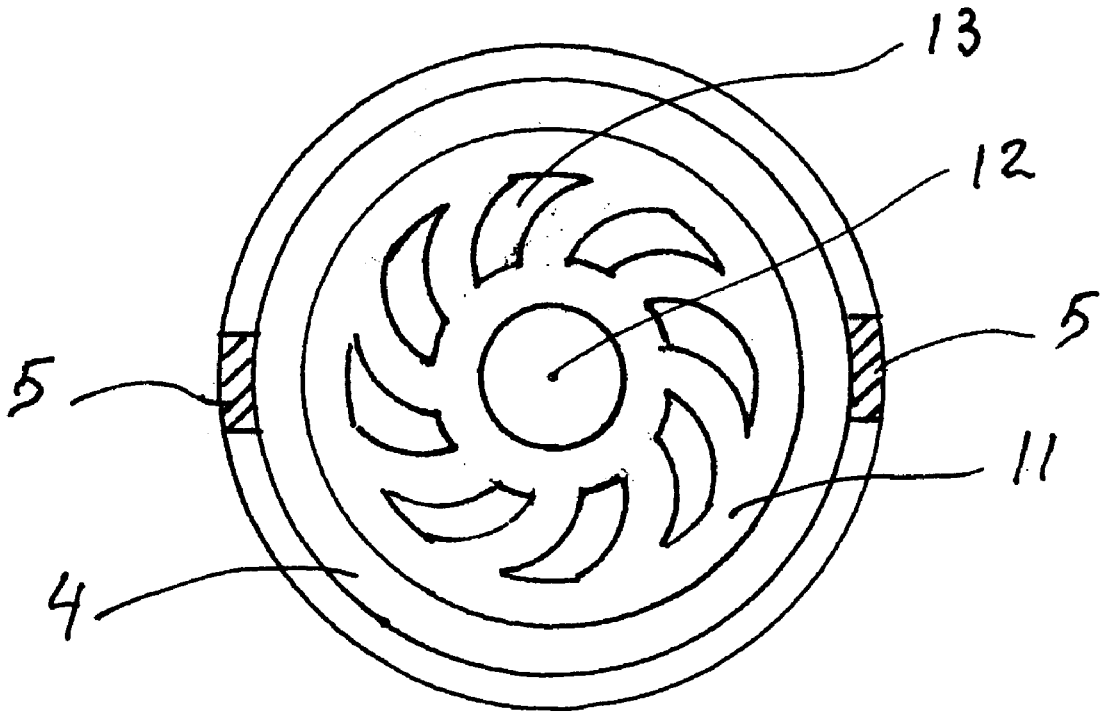

While the figuration of the central opening 12 and secondary openings 13 is preferably that shown in FIG. 4, the secondary openings 13 may also have alternative configurations such as those shown in FIGS. 5 and 6. In FIG. 5, the secondary openings 13 have a wedge shape, or a spiral shape as shown in FIG. 6 to impart a specific motion to the fluid flowing through the secondary openings 13.

Typically, the generator 10 will operate between 30–100 cycles per second, with a convenient value of 60 cycles per second to correspond to conventional AC current. However, as the chamber 25 is positioned a fixed distance from the flexible member 13, the generator can operate between 10–150 cycles per second, depending upon the use to which the pump is put. Activation of the generator 10 begins a constant upward and downward movement of the shaft 9. As the shaft 9 is connected to the moveable chamber 25, the chamber 25 moves in conjunction with the shaft.

On the upward stroke, fluid flows past the wall members 5 into the interior of the pump case 2. When the chamber 25 is positioned above the flexible member 13, a portion of the incoming fluid flows upwardly into the interior of the chamber 25 and passes through the passages 24 in the cylindrical portion 18 of the plunger 16. From the plunger, the fluid flows upwardly into the enclosure 37 formed between the top portion 19 of the plunger 16 and the closed end 29 of the chamber 25 to fill the enclosure.

On the downward stroke, the O-ring 23 disposed in the radially extending flange 20 on the plunger 16 prevents any liquid from flowing downwardly around the exterior of the plunger between the flange 20 and the side wall 26 of the chamber 25. This seal, along with the force exerted by the fluid flowing upwardly through the plunger 16, exerts a pressure on the fluid contained within the enclosure 37, forcing that fluid through the outlet 34 and into the hose 38. When the chamber 25 reaches the lowermost extent of the stroke, the outwardly extending flange 30 on the chamber 25 contacts the flexible member 13 to create a momentary fluid seal between the flange 30 and flexible member 13. In connection with this seal, the outwardly flowing fluid creates a slight vacuum within the chamber 25, such that when the chamber rises off of the member 13 in the following upward stroke, fluid is drawn into the interior of the chamber to refill the enclosure 37.

Figure 3:
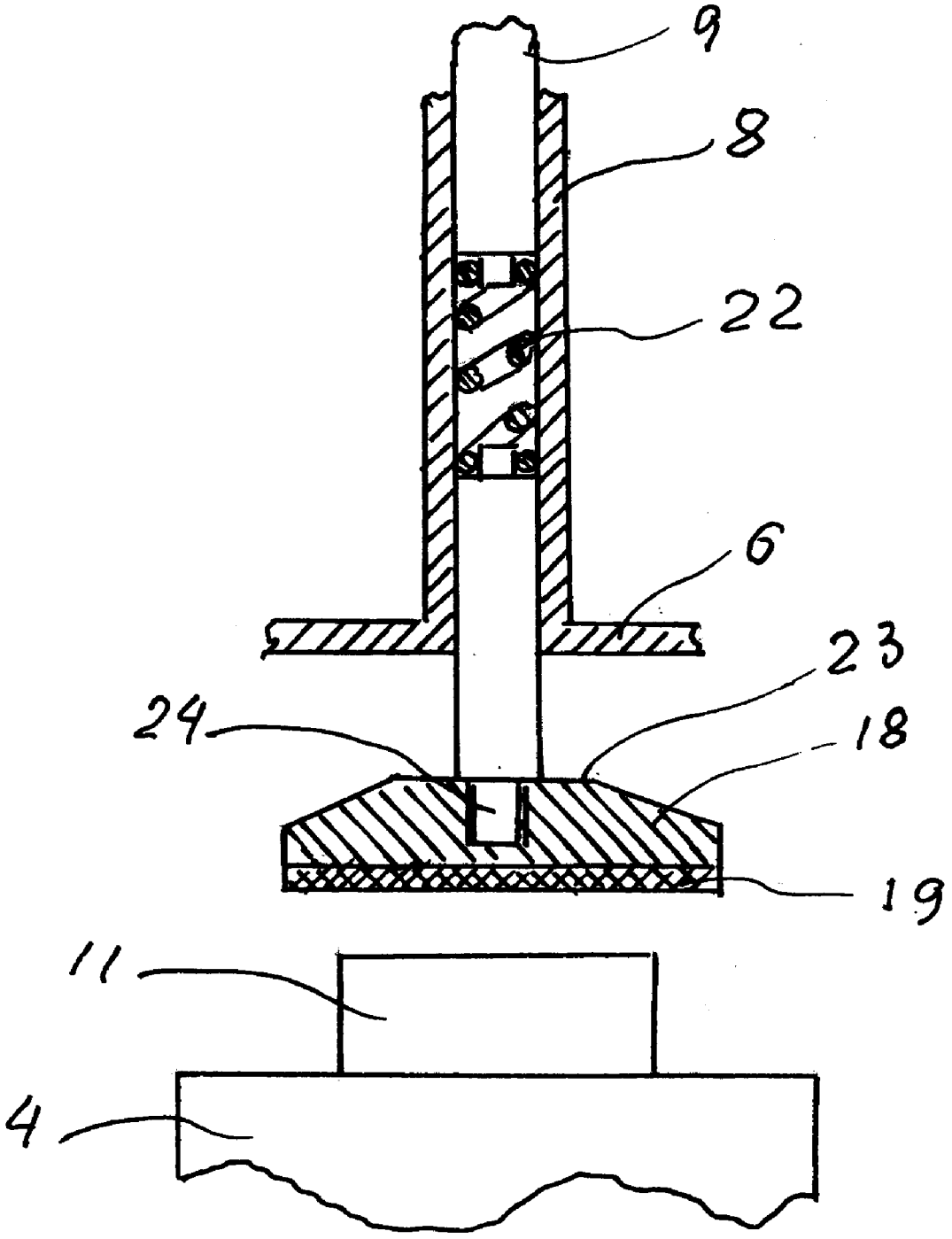
FIG. 3 is a cross-sectional view of a component of an alternative construction of the inlet branch pipe of FIG. 2.

To modify the design of this pump case 2 to provide for an increased pressure for the fluid flow exiting the pump, the plunger 16 can be altered to have the configuration shown in FIG. 3. In this alternative structure, a moveable sealing member 40 is positioned partially within the cylindrical portion 18 of the plunger 16. The sealing member 40 includes a generally circular, bottom end 42, a stem 43 extending upwardly perpendicular from the bottom end, and a circular, upper end 41 connected to the stem 43 opposite the bottom end 42 by a fastener 43*a*.The sealing member 40 is slidably mounted within the plunger such that the upper end 41 may rest on the top 19 of plunger 16 and bottom end 42 is retained within the plunger by a number of projections 44 extending into the passages 24 in plunger 16.

When the chamber 25 is moving downwardly to expel the liquid out of the enclosure 37, the upper end 41 of the sealing member 40 abuts the upper portion 19 of the plunger 16. The upper end 41 thus closes the top of plunger 16, preventing any liquid contained within the enclosure 37 from flowing outwardly through the plunger 16. Therefore, as no fluid can escape the enclosure 37 other than through the outlet 34, the pressure exerted on the fluid contained within the enclosure is increased, resulting in an increased rate of fluid flow through the outlet 34 and hose 38.

When the chamber 25 is moved upwardly, the fluid entering the chamber 25 due to the vacuum formed by the chamber and the flexible member 13 pushes upwardly against the bottom end 42 of the sealing member 40, disengaging the upper end 41 from the top 19 of plunger 16. The fluid is then permitted to flow around the bottom end 42 and stem 43 into the enclosure 37. When the chamber 25 again moves in a downward direction, the pressure exerted by the closed end 29 of the chamber 25 on the upper end 41 forces the sealing member 40 downwardly into contact with the plunger 16, preventing any fluid flow into the enclosure 37.

To increase the pressure of the outgoing fluid from the pump even further, an alternative embodiment of the present invention as shown in FIG. 4 may be used. In this embodiment, the pump case 2 is formed with a pair of angled portions 45 extending upwardly from the wall members 5 to narrow the width of the pump case at the upper end. Similarly, the cylindrical side wall of the mobile chamber 25 also includes a frustoconical upper portion 46 which tapers inwardly generally parallel to the angled sections 45 of the pump case 2. The outlet 34 is formed similarly to that found in the previous embodiment and extends from the frustoconical section 46 of the moveable chamber 25. The plunger 16 also includes a number of inwardly tapering side walls 47 extending from the base 17 towards the top 19 narrowing the upper diameter of the cylindrical portion 18. The outer edge of the outwardly extending flange 20 of the top 19 includes a sloping outer surface 49 that conforms to the slope of the upper angled wall section 45 of the moveable chamber 25. Disposed on the angled surface 49 is a resilient sealing member 50 that serves to engage the angled wall section 46 when the mobile chamber 25 is moved downwardly in a vibration sequence.

In operation, this embodiment increases the pressure at which the fluid is directed outwardly from the pump case 2 as the size of the enclosure 37 formed between the plunger 16 and the mobile chamber 25 is significantly reduced due to the slope given to both the sides of the mobile chamber 25 and the upper end 19 of the plunger 16. This reduced volume of the enclosure exerts a larger pressure on the fluid contained within the enclosure during the downward stroke of the shaft 9. The increased pressure within the enclosure translates to an increased rate of fluid flow exiting the pump through the hose 38 attached to the outlet 34.

The apparatus of this invention is particularly well suited for metering small volumes of corrosive liquids, such as acid, from large containers in which such liquids are typically shipped and stored. Also, due to the structure and operation of the pump apparatus, no measurable backpressure is generated during operation of the apparatus, enabling the fluid flow from the pump to terminate simultaneously with the deactivation of the generator.

What is claimed is:

1. An inlet branch pipe for use with a vibration generator having an oscillating shaft extending from the generator, the inlet branch pipe comprising:

a pump case having a cover including a central sleeve adapted to receive the shaft, at least one side wall extending downwardly from the cover, a base secured to the side wall opposite the cover, the base including a number of openings extending through the base, and an outlet chamber attached to the base around the openings opposite the cover; and a mobile plate disposed within the pump case and engaged with the shaft, the plate being selectively engageable with the base around the openings.

2. The pipe of claim 1 wherein the base includes an upwardly extending annular shoulder opposite the outlet chamber in which the openings are located.

3. The pipe of claim 2 wherein the openings include a generally circular central opening and a plurality of small openings spaced about the central opening.

4. The pipe of claim 3 wherein the smaller openings are generally circular in shape.

5. The pipe of claim 3 wherein the smaller openings are generally trapezoidal in shape.

6. The pipe of claim 3 wherein the smaller openings are generally spiral-shaped.

7. The pipe of claim 1 wherein the outlet chamber is integrally formed with the base.

8. The pipe of claim 1 wherein the outlet chamber includes a nozzle opposite the base.

9. The pipe of claim 1 wherein the plate includes a threaded opening that is adapted to be threadably engaged with the oscillating shaft.

10. The pipe of claim 9 wherein the plate is formed of a rigid material.

11. The pipe of claim 9 wherein the plate includes an upper rigid portion that includes the threaded opening and a lower flexible portion connected to the upper portion opposite the threaded opening.

12. The plate of claim 11 wherein the plate includes a space disposed between the upper rigid portion and the lower flexible portion.

13. The pipe of claim 1 wherein the shaft includes an upper section spaced from a lower section and a spring disposed between the upper and lower sections.

14. The pipe of claim 1 wherein the pump case, outlet chamber and mobile plate are formed of an inert material.

15. A method of pumping a fluid comprising the steps of:

a) providing a vibration generator, the generator including an outwardly extending oscillating shaft;

b) providing a pump case, the pump case having a cover including a central sleeve adapted to receive the shaft, at least one side wall extending downwardly from the cover, a base secured to the side wall opposite the cover, the base including a number of openings extending through the base, and an outlet chamber attached to the base around the openings opposite the cover;

c) providing a mobile plate selectively positionable within the pump case;

d) placing the mobile plate within the pump case;

e) inserting the shaft through the sleeve in the cover and engaging the shaft with the mobile plate;

f) placing the pump case and mobile plate in a volume of liquid to be pumped; and g) switching on the vibration generator to repeatedly move downwardly and engage the base around the openings and subsequently move upwardly away from the base.

16. The method of claim 15 further comprising the step of attaching a hose to the outlet chamber to direct the flow of liquid from the pump case.

17. A vibratory pump comprising:

a vibration generator including an oscillating shaft extending outwardly from the generator and terminating in a threaded end spaced from the generator; and p1 an inlet branch pipe secured to the shaft, the pipe including a pump case having a cover including a sleeve adapted to receive the shaft, a pair of opposed side walls depending from the cover, a base secured to the side walls opposite the cover and having a central opening and a number of secondary openings surrounding the central opening, each of the central and surrounding openings extending through the base, and an outlet chamber attached to the base opposite the cover, and a mobile plate removably positionable within the pump case and selectively engageable with the base around the central opening and secondary openings, the plate including a threaded opening that is releasably engageable with the threaded end of the shaft.

18. The pump of claim 17 wherein the mobile plate includes a lower flexible portion secured to a rigid upper portion in which the threaded opening is disposed.

19. The pump of claim 17 wherein the outlet chamber includes a nozzle opposite the base.

20. The pump of claim 19 wherein the outlet chamber is integrally formed with the base.

* * * * *

UNITED STATES PATENT AND TRADEMARK OFFICE

CERTIFICATE OF CORRECTION

PATENT NO. : 6,315,533 B1
DATED : November 13, 2001
INVENTOR(S) : Grigori Lishanski et al.

It is certified that error appears in the above-identified patent and that said Letters Patent is hereby corrected as shown below:

Column 6,
Line 33, delete “p1”.
Line 34, insert a new paragraph before “an”.

Signed and Sealed this

Third Day of December, 2002

JAMES E. ROGAN
*Director of the United States Patent and Trademark Office*